US007108200B2

(12) United States Patent
Sturman

(10) Patent No.: US 7,108,200 B2
(45) Date of Patent: Sep. 19, 2006

(54) FUEL INJECTORS AND METHODS OF FUEL INJECTION

(75) Inventor: Oded E. Sturman, Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 148 days.

(21) Appl. No.: 10/857,248

(22) Filed: May 28, 2004

(65) Prior Publication Data

US 2004/0238657 A1 Dec. 2, 2004

Related U.S. Application Data

(60) Provisional application No. 60/485,948, filed on Jul. 7, 2003, provisional application No. 60/475,022, filed on May 30, 2003.

(51) Int. Cl.
*F02M 47/02* (2006.01)
*F02M 59/00* (2006.01)

(52) U.S. Cl. ..... 239/88; 239/96; 239/90; 239/585.1; 239/124; 239/533.2; 123/467; 251/129.1; 251/129.09

(58) Field of Classification Search ..... 239/88–124, 239/533.2, 533.12, 585.1–585.5; 251/129.09, 251/129.1, 30.01; 123/300, 486, 470, 467; 335/220
See application file for complete search history.

(56) References Cited

U.S. PATENT DOCUMENTS 4,856,713 A * 8/1989 Burnett ..... 239/113
5,108,070 A * 4/1992 Tominaga ..... 251/65
5,429,309 A 7/1995 Stockner
5,460,329 A 10/1995 Sturman
6,026,785 A 2/2000 Zuo
6,148,778 A 11/2000 Sturman
6,161,770 A 12/2000 Sturman
6,173,685 B1 1/2001 Sturman
6,257,499 B1 7/2001 Sturman
6,308,690 B1 * 10/2001 Sturman ..... 123/508
6,360,728 B1 3/2002 Sturman
6,378,497 B1 4/2002 Keyster et al.
6,474,304 B1 11/2002 Lei
6,550,453 B1 4/2003 Tian
2003/0178508 A1 9/2003 Coldren

* cited by examiner

*Primary Examiner*—Dinh Q. Nguyen
(74) *Attorney, Agent, or Firm*—Blakely Sokoloff Taylor & Zafman LLP

(57) ABSTRACT

Fuel injectors and methods of fuel injection allowing direct control of the flow of fuel at an intensified pressure to the needle. A valve, typically a spool valve, is placed in the fuel passage between the intensifier actuation piston and the needle, and controlled by a control valve which may be independent of the control valve controlling the coupling of actuation fluid and a vent to the intensifier actuation piston. This allows achievement of intensification before initiating injection, and control of multiple injections in a single injection event while maintaining fuel intensification throughout the duration of the injection event. Various embodiments are disclosed, including embodiments having multiple intensifiers, having control of pressure over the needle, having two stage control valve systems for control of intensifier actuation fluid, and combining control of one of the intensifiers and the valve controlling flow of intensified fuel to the needle for injection.

41 Claims, 12 Drawing Sheets

FUEL INJECTORS AND METHODS OF FUEL INJECTION

CROSS-REFERENCE TO RELATED APPLICATION

This application claims the benefit of U.S. Provisional Patent Application No. 60/475,022 filed May 30, 2003 and U.S. Provisional Patent Application No. 60/485,948 filed Jul. 7, 2003.

BACKGROUND OF THE INVENTION

1. Field of the Invention

The present invention relates to the field of fuel injectors, and more particularly to intensifier type fuel injectors.

2. Prior Art

Intensifier type fuel injectors are well known in the prior art. As an example, see U.S. Pat. No. 5,460,329. That patent discloses an electromagnetically actuated spool valve for controlling the coupling of an area over an intensifier piston to an actuating fluid under pressure or to a vent, the intensifier piston driving a smaller piston to intensify the pressure of fuel for injection purposes. While various types of valves are known for use with such injectors, the valves generally control the flow of actuation fluid to and from the area over intensifier piston.

While control valves of the foregoing type can be made relatively small and fast-acting, control of actuation fluid in this manner for direct fuel injection has certain limitations. In particular, a diesel fuel injector may intensify fuel pressure to a pressure on the order of 20,000 psi or higher, at which pressures the fuel will undergo substantial compression. This, in turn, means that there must be substantial actuation fluid flow into the chamber over the larger piston of the intensifier. In that regard, while, by way of an example, in an intensifier having an area ratio of 9:1, the pressure of the actuating fluid over the larger piston will only be ⅑ of the intensified pressure, the flow of actuation fluid required to achieve the compression and intensification of the fuel will be nine times that required because of the compression of the intensified fuel, thereby resulting in at least as much volumetric compression in the actuation fluid over the intensifier piston as in the intensified fuel. Consequently, intensification on actuation of the control valve(s) requires significant actuation fluid flow, and is therefore less than immediate. Also, this flow requirement sets the minimum size for the electrically operated control valves, and further requires de-intensification between injection events, making multiple injections during a single injection event difficult and energy consuming.

DETAILED DESCRIPTION OF THE PREFERRED EMBODIMENTS

Figure 1:
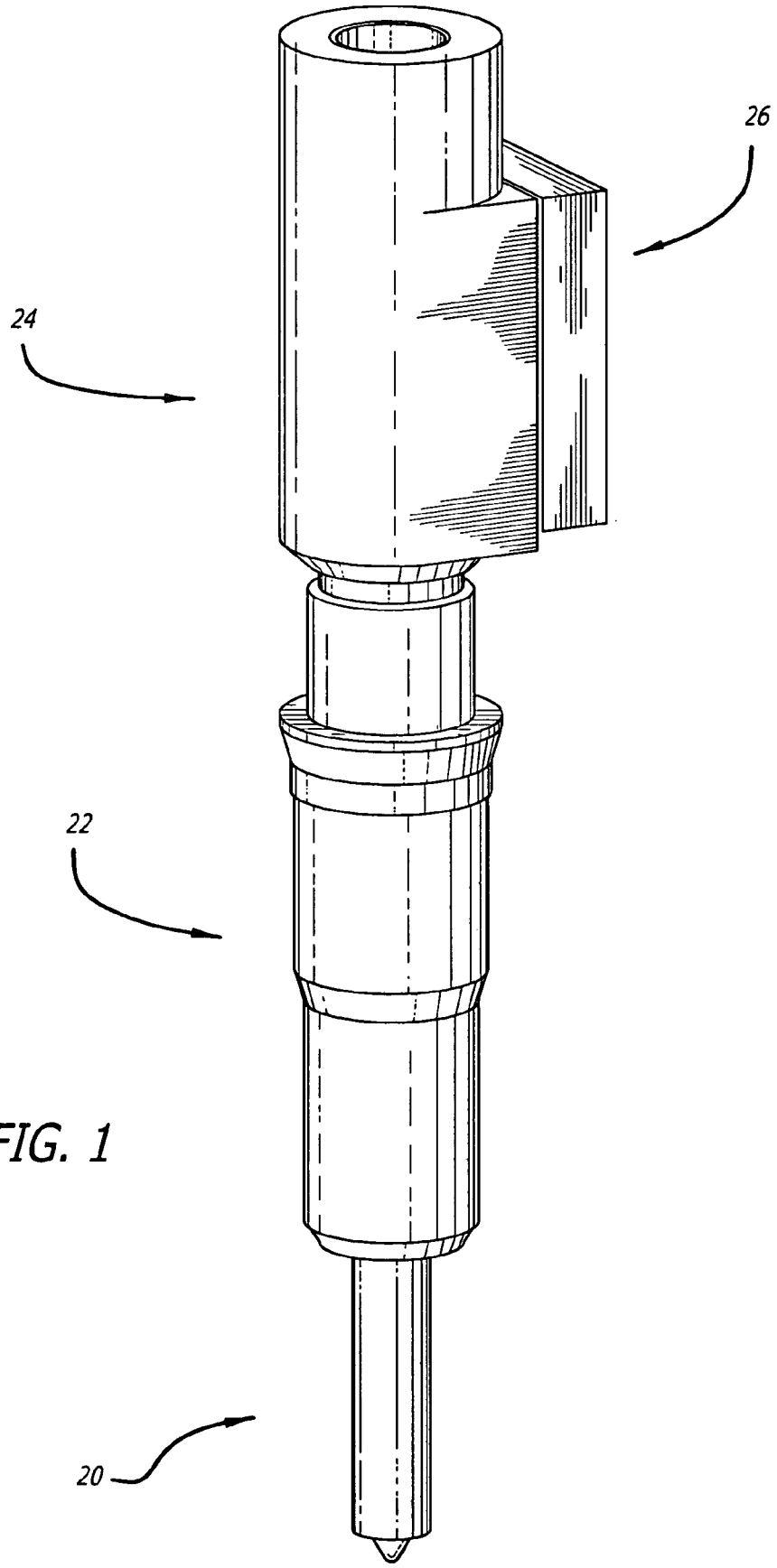
FIG. 1 is a perspective view of one embodiment of fuel injector in accordance with the present invention.

FIG. 1 is a perspective view of one embodiment of fuel injector in accordance with the present invention. The major parts of the fuel injector visible in this figure are the injection tip or nozzle, generally indicated by the numeral 20, a lower injector body assembly body 22, and upper injector body assembly 24, and a control module 26.

Figure 2:
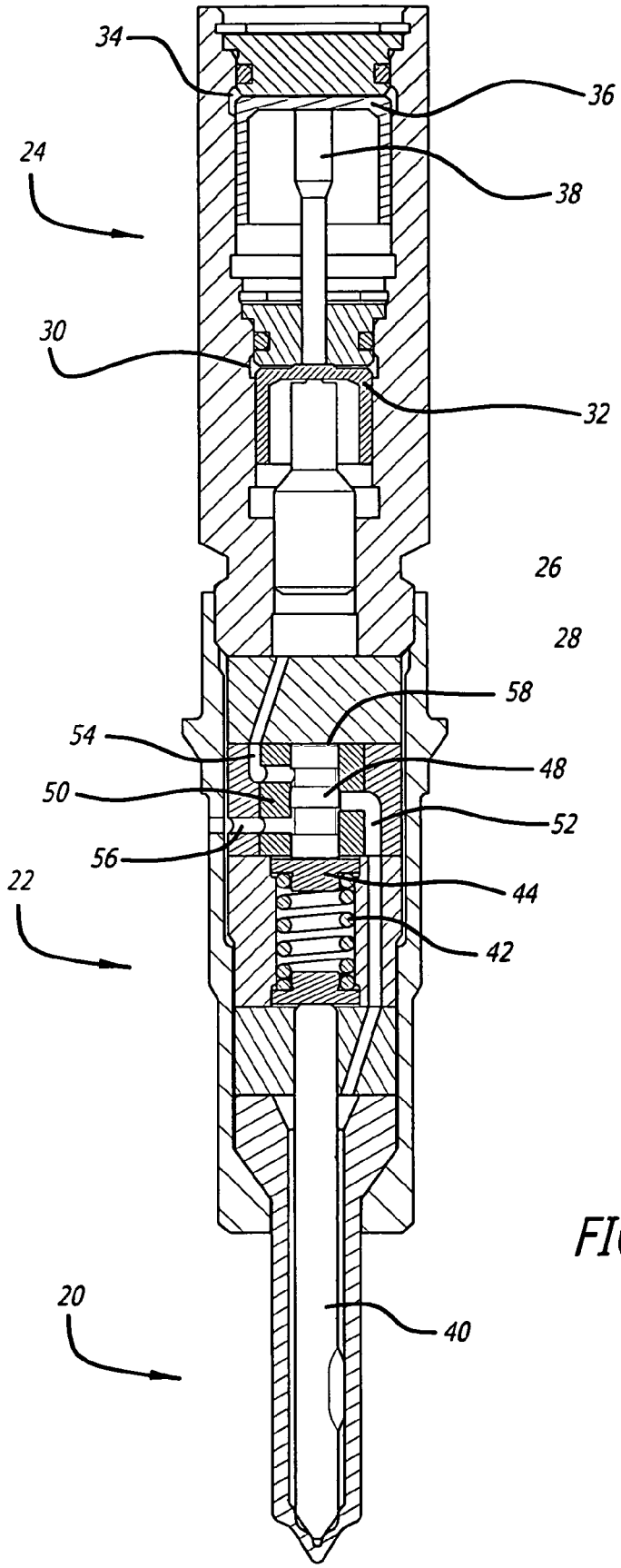
FIG. 2 is a cross-section of the injector of FIG. 1.
Figure 3:
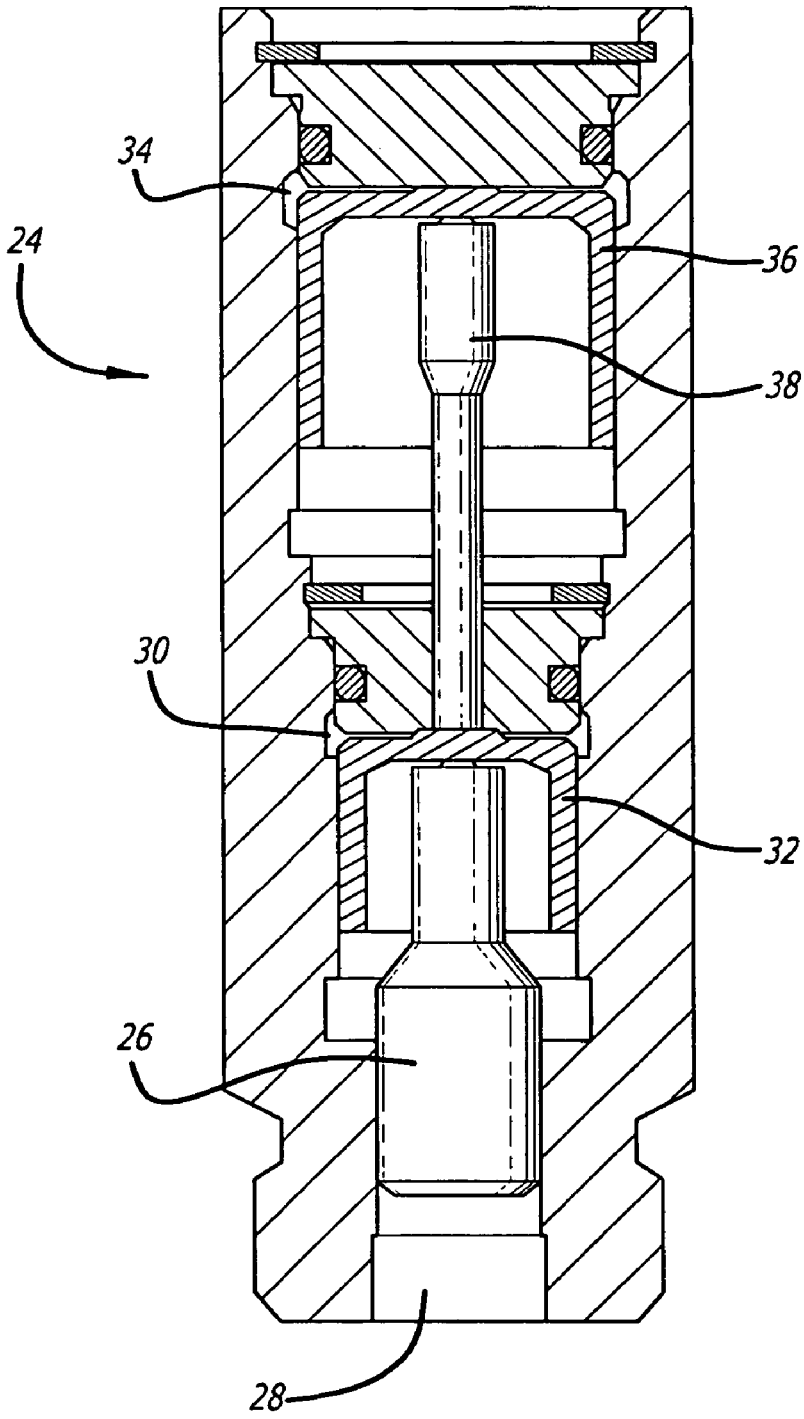
FIG. 3 is a cross-section of the upper injector body assembly of FIG. 2, taken on a larger scale.
Figure 4:
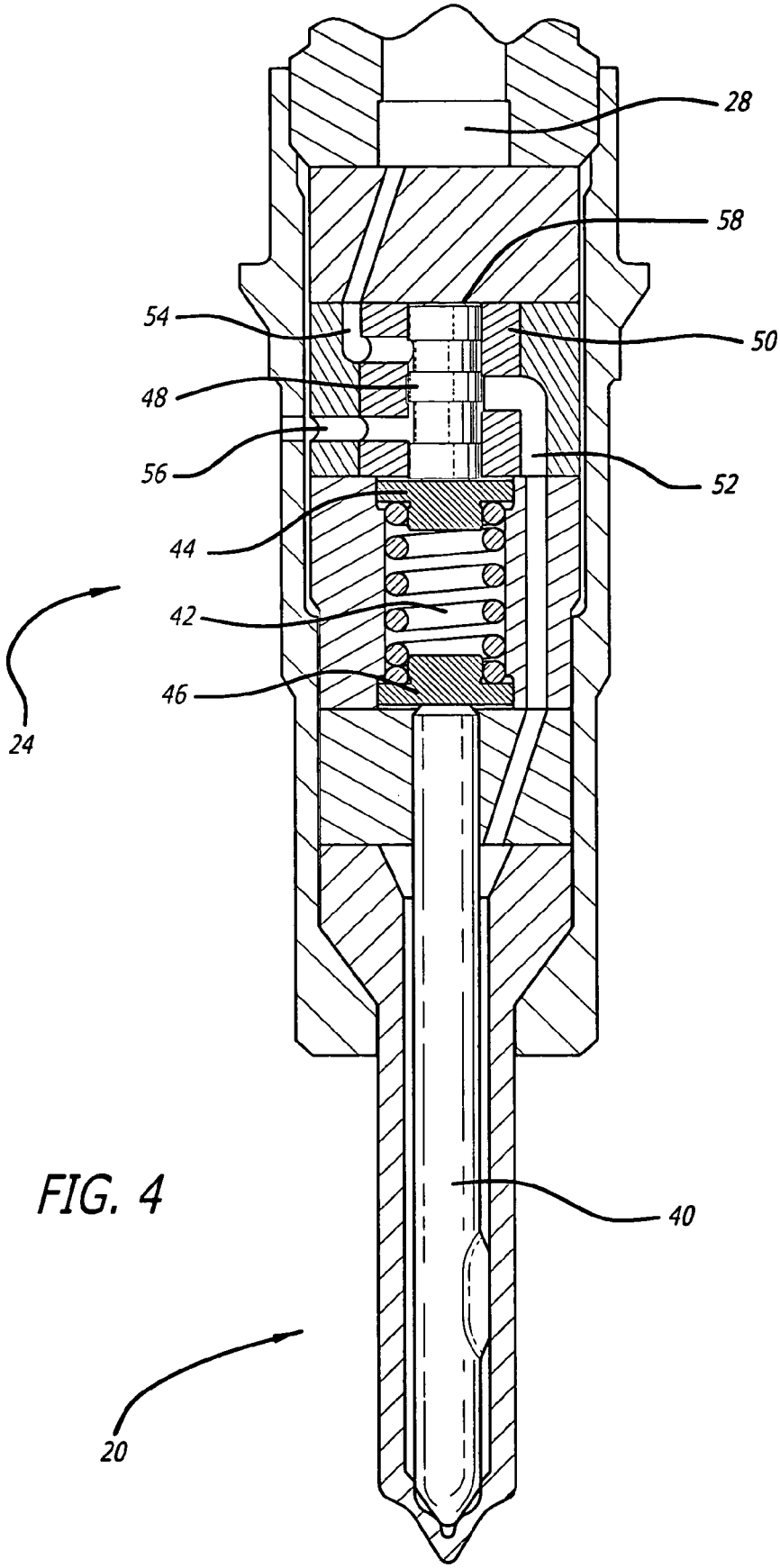
FIG. 4 is a cross-section of the lower injector body assembly of FIG. 2, taken on a larger scale.

FIG. 2 presents a cross-section of the injector of FIG. 1 illustrating the cooperation of the injection tip 20, the various parts of the lower injection body assembly 22 and the upper injector body assembly 24. FIGS. 3 and 4 show the same cross-sections of the upper injector body assembly and the lower injector body assembly, respectively, on a larger scale. As illustrated in FIG. 3, the upper injector body assembly 24 is comprised of an intensifier piston 26 operative to provide a high or intensified pressure to the fuel in the intensifier chamber 28 in response to a downward force on the intensifier piston. The intensifier piston 26 may be driven downward by applying an actuating fluid pressure in region 30, pressurizing the region above piston 32, by applying actuating fluid pressure in region 34 above piston 36 operative against intensifier drive pin 38, or by applying actuating fluid pressure to both regions 30 and 34. In a preferred embodiment, the cross-sectional area of piston 32 is approximately three times the cross-sectional area of intensifier piston 26, with piston 36 having a cross-sectional area approximately equal to six times the cross-sectional area of intensifier piston 26. Thus, intensification ratios of approximately three, six and nine (by pressurizing the region over both pistons 32 and 36) may be achieved. These numbers, of course, are exemplary only and any ratios may be used as desired. Alternatively, a control may be used to pressurize either one or the other but not both regions 30 and 34 at the same time, or by way of further alternative, the aspects of the invention inherent in the lower injector body assembly and control may be practiced with simply a single intensifier actuation piston if desired.

Certain details of the upper injector body assembly 24 are not illustrated in FIG. 3, though the same are obvious design aspects that would be apparent to anyone of reasonable skill in the art. These, of course, include the porting for applying actuation fluid pressure to region 30 and/or to region 34, for venting the regions below intensifier actuation pistons 32 and 36 to avoid the possibility of a hydraulic lock, and the means to return the intensifier piston 26 and the actuation pistons to their upper position and replenish the fuel in the intensifier chamber 28 between injection cycles, whether by fuel supply pressure in the intensifier chamber, a return spring, a combination of fuel pressure and return spring, or something else.

Now referring to FIGS. 2 and 4, cross-sections of the lower injector body assembly 24 may be seen. The injection tip 20 is of a generally conventional design, the check valve or needle 40 therein being encouraged downward to a check valve closed position by coil spring 42 operative against spring endplates 44 and 46. The upper spring endplate 44 is also in contact with the lower end of the spool 48 of a spool valve operative within a spool valve body 50. This spool valve either couples region 52 providing fuel under an intensified pressure to the internal region of injector tip 20 from port 54 coupled to the intensifier chamber 28 (see also FIG. 3), or couples region 52 through port 56 to a lower pressure vent or drain region. In the position shown, the spool valve member 48 is positioned within the spool valve body 50 to couple region 52 to the drain 56 so the fuel in the check valve region is not substantially pressurized, and to block flow from port 54 to region 52.

Not readily visible in the cross-section of FIG. 4 is a porting of fluid typically under the same pressure as the intensifier actuation fluid pressure to the region 58 above the spool 48. As shall be subsequently described in detail, an actuation fluid under pressure is controllably applied to the region 58 above spool 48 to control the position of the spool. In particular, at the beginning of an injection cycle, in the embodiment being described, intensifier actuation fluid under pressure will be applied to region 30 over the actuator piston 32 (see FIG. 3), to region 34 over the intensifier actuation piston 36, or both regions 30 and 34, resulting in intensified fuel pressure in intensifier chamber 28 and, thus, port 54 (FIG. 4). Shortly thereafter, typically after the intensification pressure has been obtained, actuation fluid under pressure is applied to region 58 to move spool 48 to a downward position against spring 42, coupling the intensified fuel in port 54 through port 52 to initiate injection through the check valve 40 which, as a result of high pressure fuel, will move upward against coil spring 42 to initiate fuel injection.

Injection is terminated by first venting region 56 above spool 48, allowing coil spring 42 to move the spool to the position shown to terminate the supply of intensified fuel to the check valve, followed by the controlled venting of the intensifier actuation piston or pistons to allow the return of the intensifier piston(s) to its starting position and the refilling of the intensifier chamber with fuel under the effect of fuel supply pressure or the combination of fuel supply pressure and return spring (not shown). It should be noted that while in the preferred embodiment, the actuation fluid for the intensifier and for spool 56 is fuel, other actuation fluids such as engine oil may be used as desired.

Figure 5A:
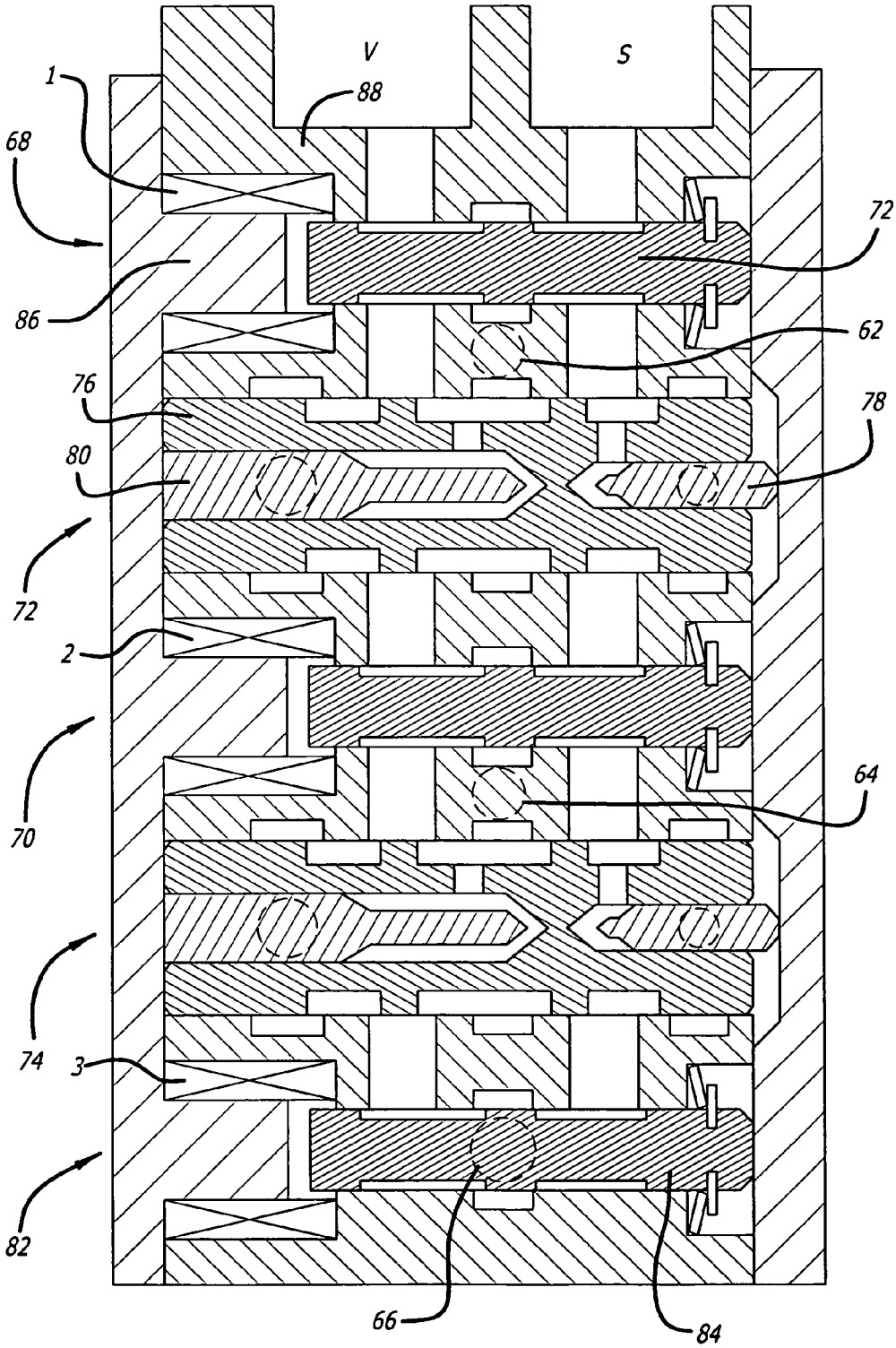
FIG. 5*a* is a cross section of an exemplary control module 26 as used in the fuel injector embodiment of FIG. 1.

Now referring to FIG. 5*a*, a cross section of an exemplary control module 26 (see FIG. 1) may be seen. The major porting for the module includes an actuation fluid supply port S that supplies fluid under the actuation pressure to three solenoid actuated pilot spool valves and two main spool valves to be described. The porting also includes a vent port V, also communicating with the three solenoid actuated spool valves and the two main valves, and further includes three outlet passages 62, 64 and 66 coupled to the injector body assemblies hereinbefore described. Two of the solenoid actuated spool valves or pilot valves, indicated by the numerals 68 and 70, indirectly control the coupling of ports 62 and 64, respectively, to the source S or vent V ports. The ports at 62 control the coupling of fluid to region 34 over upper intensifier piston 36 (see FIG. 3), with port 64 controlling the coupling of fluid to region 30 over lower intensifier piston 32. Port 66 controls the coupling of actuation fluid to region 30 over intensifier actuation piston 32. Since the spool valve 68 and 70 (FIG. 5*a*) may be identical, details of only one will be described.

In particular, spool valve 68 is comprised of a solenoid coil 1 controllably magnetizing a magnetic circuit which includes spool 72 of the spool valve and magnetic members 86 and valve body 88, the spool 72 being encouraged to the right-hand position by the spring washer 90 at the right-hand end of the spool and magnetically attractable to a left-hand position as desired. While the spool valve 68 in FIG. 5 may be a magnetically latching spool valve, magnetic latching is not a necessity, as a non-magnetic latching spool valve may also be used if desired. Similarly, other return springs, dual coil actuators, etc. may be used as desired, as the specific valves described are exemplary only and not a limitation of the invention.

Pilot valve 68 controls a main valve, generally indicated by the numeral 72, while spool valve 70 controls main valve 74. The main valves 72 and 74 may be substantially identical, both being spool valves in the embodiment shown. With respect to main valve 72, the right end of the spool 76 therein contains a small bore with sliding piston pin 78 therein which is pressurized on the left end by the pressure of the fluid in the supply port S and is vented at the right end. At the left end of spool 76 is another piston pin 80 within a corresponding larger bore in the spool 76, with the right end of pin 80 being coupled either to the supply port pressure or the vent pressure as controlled by the position of spool 72 in pilot valve 68. Thus, the spool valve 68 controls the position of spool 76, allowing a small spool valve with a very short stroke to cause a longer stroke in a somewhat larger diameter spool valve to control a relatively large flow area by a relatively small pilot spool valve. In that regard, for clarity, actual proportions are not shown. The position of spool 76 in turn controls the coupling of port 62 to the intensifier actuation fluid supply or the vent, port 62 being coupled to region 34 above intensifier piston 36. Similarly, pilot valve 70 controls main valve 74 and, thus, the coupling of port 64 coupled to region 30 over intensifier piston 32 to the intensifier actuation fluid pressure or vent in a similar manner.

Finally, a third spool valve, generally indicated by the numeral 82, controls the position of spool 84 which in turn controls the coupling of port 66 to the actuation fluid supply or vent, depending on the position of the spool. Port 66 is coupled to the region 58 (FIG. 4) over spool 48 to control the coupling of fuel under the intensified pressure to the check valve. This valve, when in the unactuated position, should preferably couple the check valve fluid to vent, not to the supply pressure, as a failsafe feature, and for the same reason, preferably this valve particularly is not magnetically latching, the return spring overcoming the inherent magnetic force caused by the residual magnetism in the magnetic circuit, including the spool.

The advantage of the assembly hereinbefore described is that the speed with which actual injection may be initiated and terminated is extremely high, as it is controlled by a small spool valve 82 controlling a small fuel injection fluid flow after the intensified pressure is reached, as opposed to the flow of intensifier actuation fluid which is many times higher. Thus, while the two-stage control for the application of intensifier actuating fluid to the intensifier piston or pistons may be substantially slower, that does not affect the speed of initiation or termination of injection. In that regard, for a single combustion event, the present invention is fast enough to use multiple injections of small quantities of fuel for pilot-injection purposes and/or for extending the overall injection period for such purposes as engine operation under low load and/or lower engine speed operation using a single intensification cycle, and in fact, the intensified pressure of the fuel may be changed during the multiple injections by control of pilot valve 68 and 70 during or between those injections. Thus, pilot injection may be at one fuel pressure, and the subsequent injection or injections at a different pressure, typically but not necessarily a higher pressure. In a preferred embodiment, the control module of FIG. 5*a* measures approximately 1 inch wide by 2 inches high by ½ inch thick.

Figure 5B:
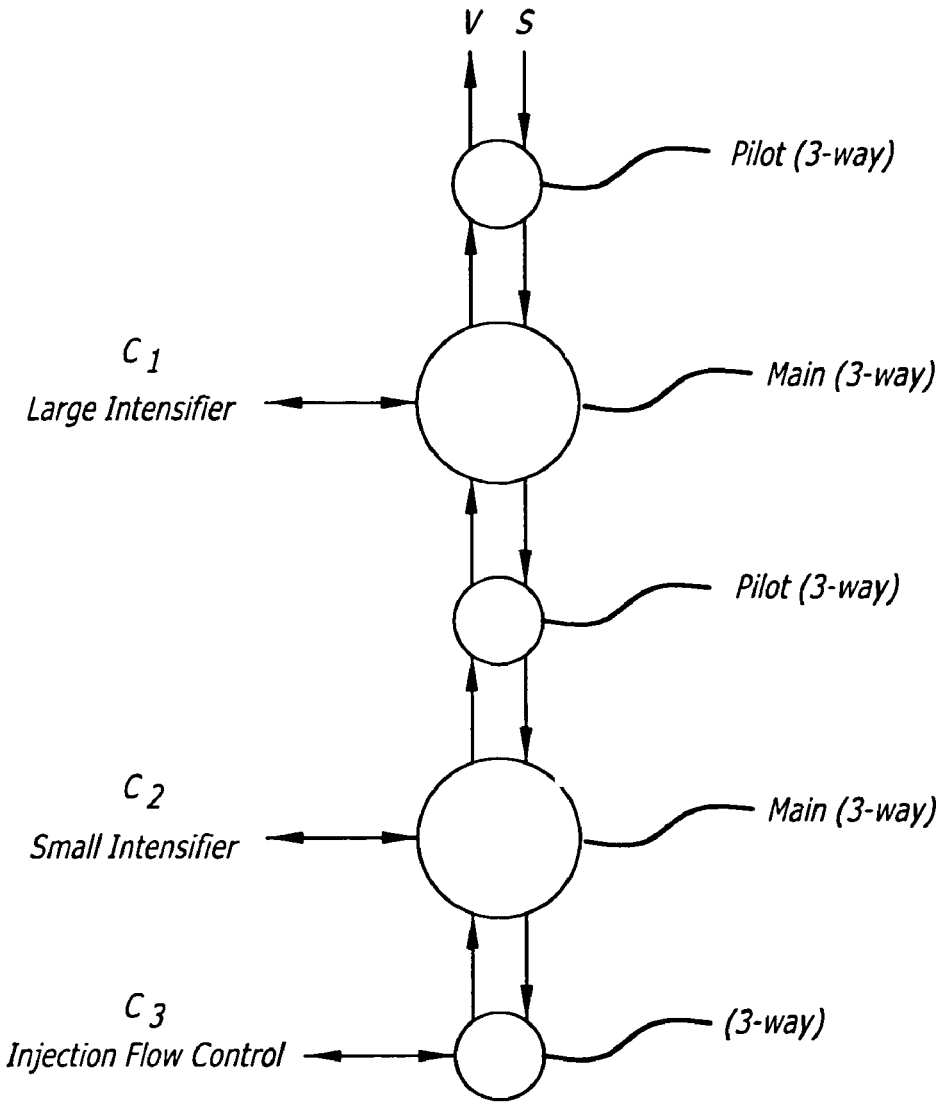
FIG. 5*b* is a diagram is a control fluid flow diagram for the control module of FIG. 5*a*.

FIG. 5*b* provides a simplified diagram of the control module of FIG. 5*a*. As may be seen therein, in this exemplary embodiment, the supply and vent ports are coupled to all five valves. The upper pilot valve, which in this embodiment is a 3-way spool valve, controls the upper main 3-way main spool valve controlling the large intensifier 36, the next pilot valve, which in this embodiment is also a 3-way spool valve, controls the upper main 3-way main spool valve controlling the small intensifier 32, with the bottom valve, which may be the same as the pilot valves, controls the injection flow control valve. Preferably the injection flow control valve is not magnetically latching as a fail safe feature, though the pilot valves may be non latching also to remove intensified pressure from the actual intensified fuel flow control spool valve spool 48.

Other embodiments disclosed herein add control of fluid pressure over the needle 40 by including an additional valve mechanically coupled, in many embodiments actually integral with, the spool 48. This provides substantially simultaneous shifting between a) pressure over the "top" of the needle and "vent" pressure at the lower end of the needle, and b) vent pressure over the top of the needle and fuel at an intensified pressure for injection at the bottom of the needle.

Figure 6:
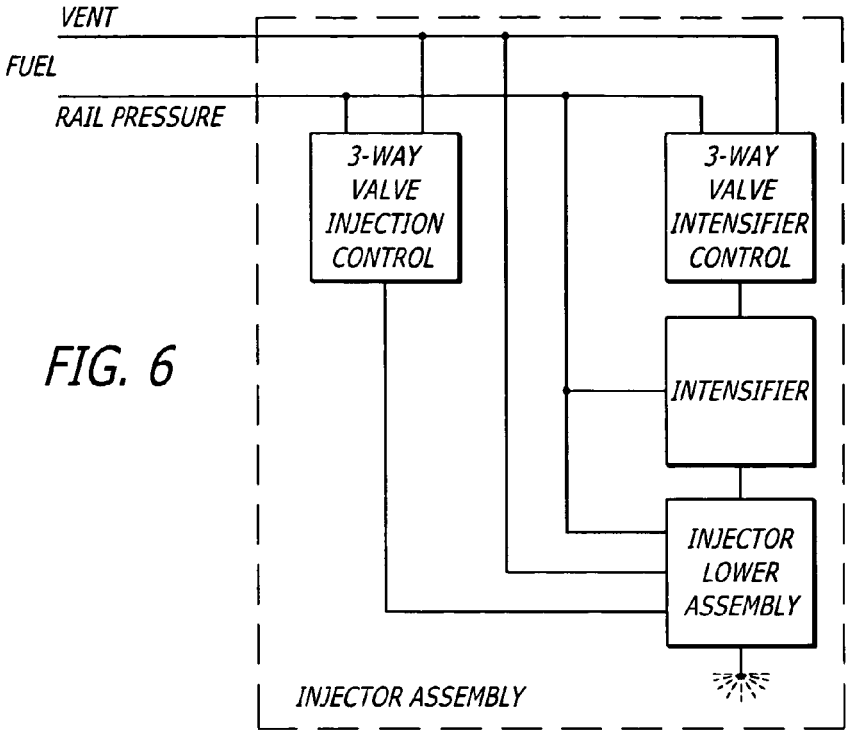
FIG. 6 is a block diagram for an injector assembly wherein the intensifier is powered by the fuel rail pressure through a three-way intensifier control valve.
Figure 7:
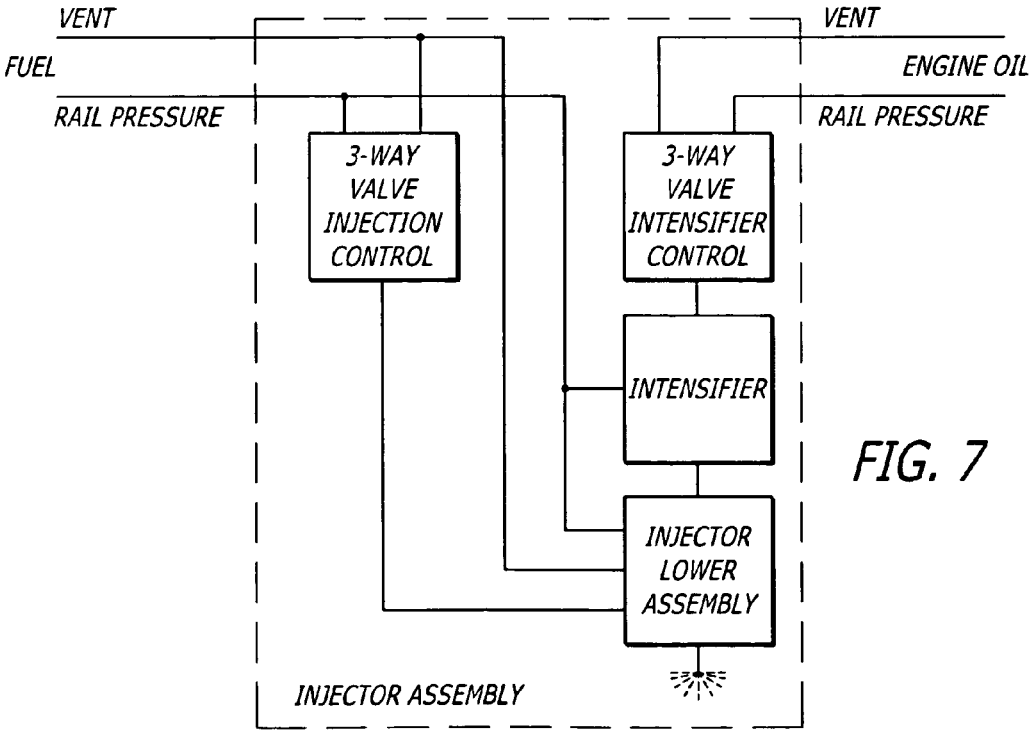
FIG. 7 is a block diagram for an injector assembly wherein the intensifier is powered by engine oil under pressure rather than fuel.

Before going into the detailed operation of the injector, block diagrams of embodiments of such overall injector assemblies may be seen in FIGS. 6 and 7. FIG. 6 provides a block diagram for an injector assembly wherein the intensifier is powered by the fuel rail pressure through a three-way intensifier control valve. Similarly, a three-way injection control valve is used to control the coupling of rail pressure or a vent to the hydraulically controlled needle control valve in the lower assembly of the injector. Either or both of these control valves may be in other forms as desired, such as by way of example, either or both of the valves, as in the earlier embodiments, may be a pair of two-way valves, preferably solenoid operated spool valves using one or two actuator coils, with or without magnetic latching. The control valves may be single actuator spring return or double actuator, either of which may or may not include magnetic latching, though other variations of valves, including other variations of spool valves, may be used as desired.

The embodiment of FIG. 7 is similar to that of FIG. 6, though the intensifier in this embodiment is powered by engine oil under pressure rather than fuel. If desired, the valve in the lower assembly of the injector could also be powered by engine oil under pressure, though this is not preferred. In any event, in the description to follow, as well as in the prior embodiments, either actuating fluid will simply be referred to as actuating fluid, whether by way of example, the actuating fluid is fuel rail pressure or engine oil rail pressure. The vent pressure may be atmospheric pressure or some other pressure, frequently a pressure somewhat above atmospheric pressure.

Figure 8:
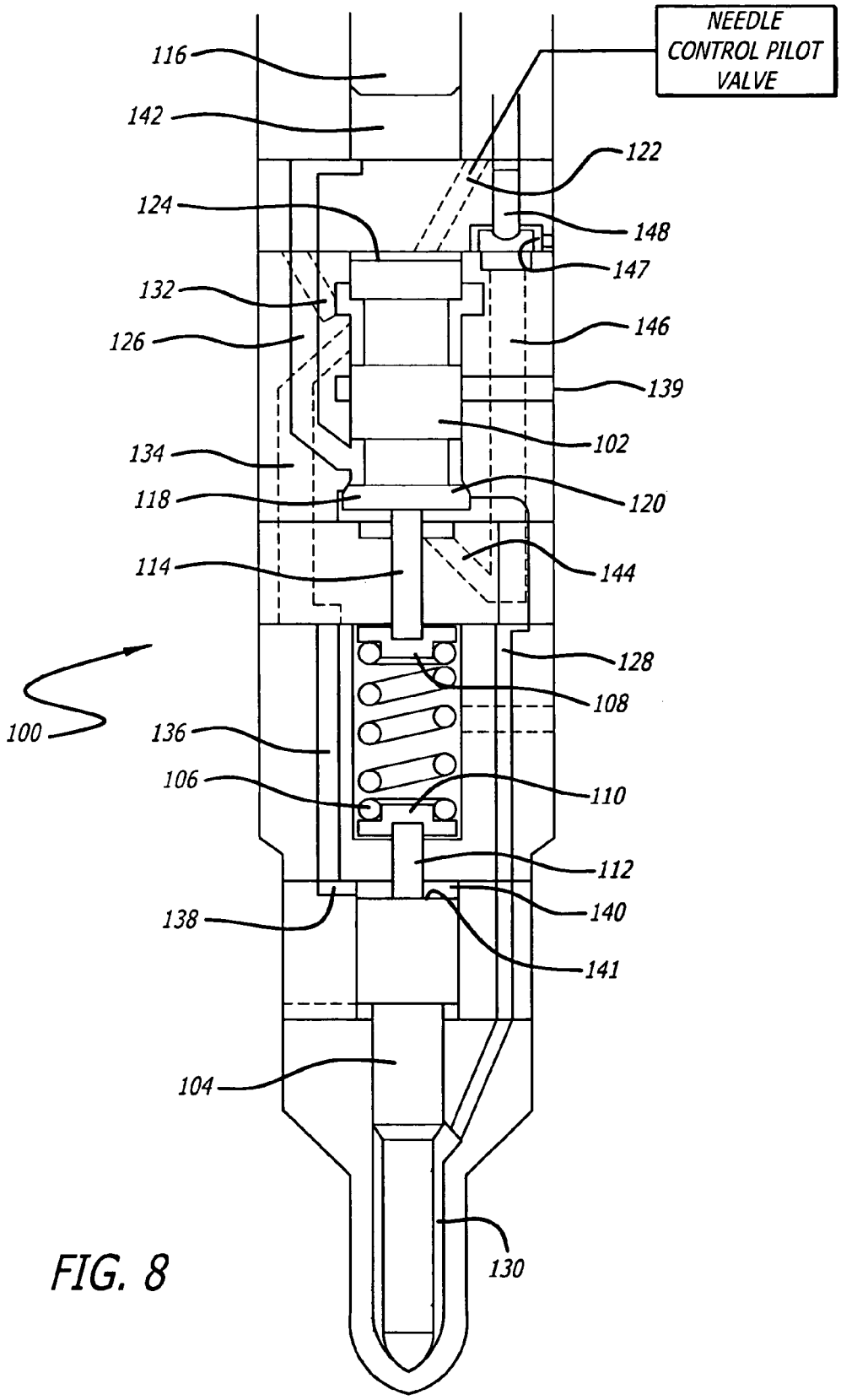
FIG. 8 is a cross section of a lower injector assembly in accordance with another embodiment of the present invention.

Now referring to FIG. 8, a cross section of a lower injector assembly in accordance with one such embodiment of the present invention may be seen. This embodiment includes within the lower injector assembly, generally indicated by the numeral 100, a spool 102, a needle 104, coil spring 106 with end caps 108 and 110, and pins 112 and 114. Also visible in FIG. 8 is intensifier piston 116, which may be powered by fuel at rail pressure or engine oil under pressure, as controlled by electronically controlled valving as previously described and as is now well known in the art. With no pressure in the injector (neither rail pressure nor intensified fuel pressure), coil spring 106 pushes down on end cap 110, pushing pin 112 against the top of needle 104 to hold the needle closed. At the same time, the coil spring 106 pushes upward on end cap 108 against pin 114, which in turn pushes spool 102 upward to its maximum upward position. In that regard, in the specific embodiment, end 118 of spool 102 is larger than the diameter of the rest of the spool, and acts as a poppet valve to seal against valve seat 120 in the body of the injector, the poppet valve hereafter being referred to as poppet valve (118,120).

In operation, the position of spool 102 is controlled by controllably coupling passage 122, and thus chamber 124 over the top of spool 102, to either rail pressure or a vent pressure. This is provided by a three-way needle control pilot valve, preferably a spool valve, shown schematically in the Figure, that may be of any of various types well known in the art. With passage 122 coupled to vent, the spool will be in its upper position because of spring 106 pushing upward on spring retainer 108 and in turn, on pin 114 pushing against the lower end of the spool. (The chamber in which the spring resides is vented.) In this position, fuel from the intensifier in passage 126, whether at an intensified pressure or approximately rail pressure during the intensifier return, is blocked by the poppet valve (118,120) from flowing through passage 128 to the lower needle chamber 130. At the same time, rail pressure is coupled from passage 132 through the spool valve and passages 134, 136 and 138 to chamber 140 over area 141 on the top of the needle 104 to hold the needle closed (down), the underside area 141 being vented.

When the needle control pilot valve is in a position to couple rail pressure through passage 122 to chamber 124 over the spool 102, the spool will move downward to its lower position, closing fluid communication between passage 132 and 134, and coupling passage 134 to the vent 139. It also closes communication between passages 144 and 128, and opens the poppet valve (118,120), coupling intensifier chamber 142 to the lower needle chamber 130 through the passages 126 and 128.

Consequently, for an injection event, an intensifier control valve means, which can be a 3-way intensifier control spool valve, can be actuated to couple rail pressure to the intensifier to intensify the fuel pressure as in the previously described embodiments, followed by actuation of the needle control pilot valve to couple the intensified fuel to the lower needle chamber and venting the region over the needle to initiate injection. Injection may be terminated by movement of the needle control pilot valve and the intensifier control valve to the opposite states, preferably but not necessarily by first movement of the needle control pilot valve, followed substantially immediately by movement of the intensifier control valve, to the opposite states. This also opens fluid communication between passages 144 and 128. Passage 144 is coupled to passage 146 having a valve at the top thereof coupled to a vent 147 and encouraged to the closed position by rail pressure on pin 148 acting on a seat at the top of passage 146. This sets a lower pressure limit for the lower needle chamber 130, in this embodiment, preferably to some fraction of the rail pressure.

In the foregoing embodiment, if multiple injections are to be used, such as, by way of example, a pre-injection followed by one or more main injection, the intensifier control valve may be actuated to intensify the fuel pressure, with the needle control pilot valve being actuated multiple times during a single actuation of the intensifier control valve to provide the desired multiple injections without requiring the time and energy that would be associated with multiple pressure intensification cycles. Also, while the embodiment of FIG. 8 utilizes a poppet valve for coupling the intensified fuel to the lower needle chamber 130, a spool valve on spool 102 may also be used for that purpose.

Figure 9:
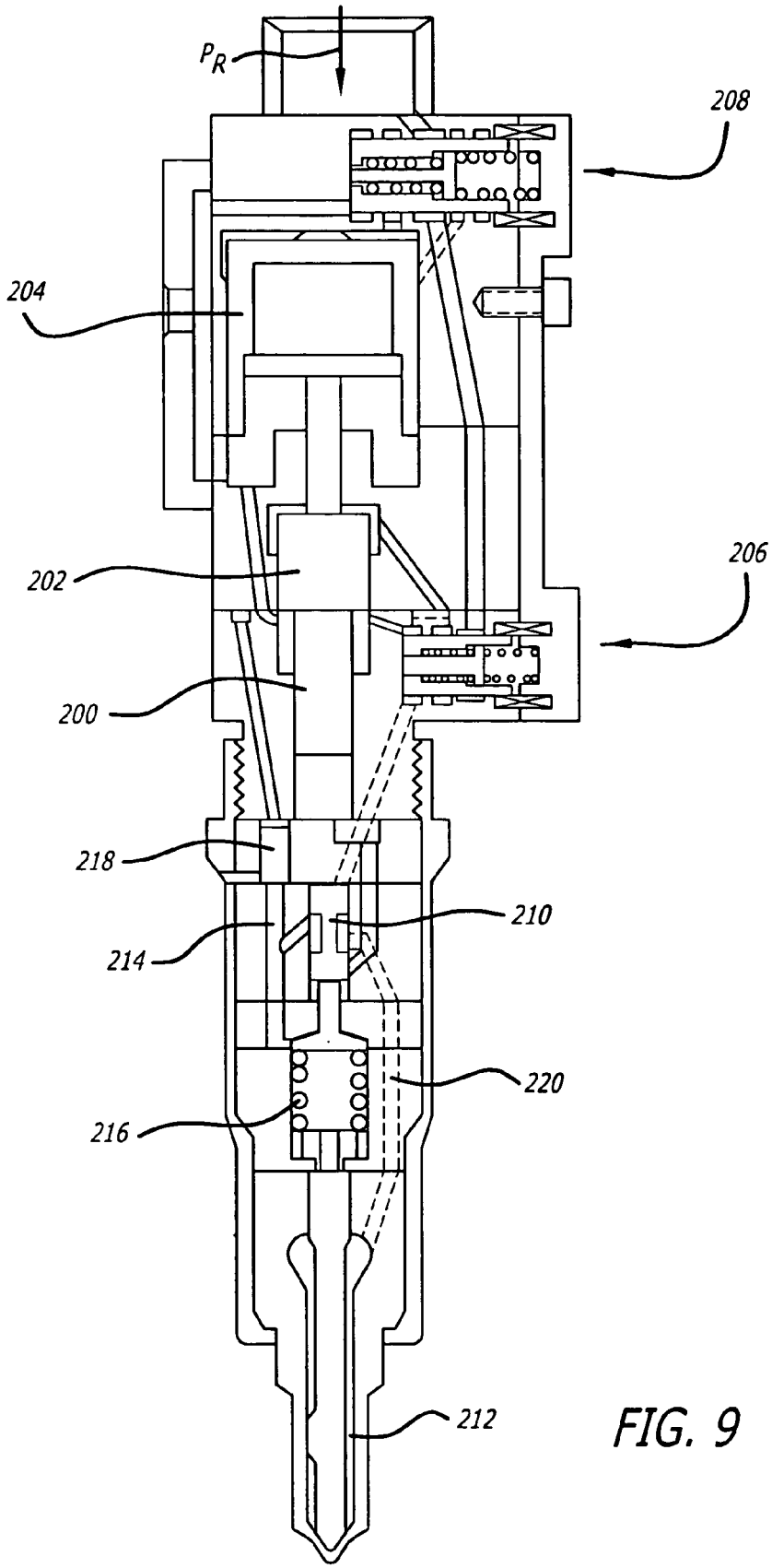
FIG. 9 is a cross section of an injector in accordance with the present invention having multiple intensifier pistons.

In addition, the intensifier itself may have a single or a multiple, typically a dual, intensifier piston, that is, may be comprised of one or two driving pistons of equal or preferably unequal areas, preferably concentric or coaxial, each controlled by its own pilot control valve so is to be capable of achieving any of multiple intensified fuel pressures, such as described with respect to previously described embodiments and shown in FIG. 9. In the embodiment of FIG. 9, intensifying piston 202 might be given an area 3 times that of the intensifier piston 200, with intensifying piston 204 having an area 6 times that of intensifier piston 200, as before. Thus, intensification ratios of 3, 6 and 9 could be achieved by actuation of either or both control valves 206 and 208.

In the embodiment of FIG. 9, control valve 206, schematically illustrated, also controls spool 210, so that actuation of the intensifying piston 202 substantially simultaneously couples the intensified fuel through valve 210 through passage 220 to the lower needle chamber 212 to initiate injection. Injection is terminated by putting control valve 206 in the opposite state, blocking intensified fuel from the lower needle chamber 212 and coupling the lower needle chamber to a vent or relief valve through passage 214. In this embodiment, pin 218, subjected to rail pressure on the top thereof through porting, not all of which is not shown, provides a 2 to 1 relief ratio, so that the minimum pressure in the lower needle chamber 212 between injection events will be approximately twice rail pressure. The areas or area ratios may be set so that the residual pressure in the lower needle chamber 212 between injection events, together with coil spring 216, will provide an upward force that is less than the downward force provided by rail pressure acting on the cross-sectional area of the spool when valve 206 is actuated.

The advantage of the embodiment of FIG. 9 is that through the use of only two electronically controlled control valves, needle control and injection flow control are achievable, as are multiple intensification pressure ratios. The disadvantage, of course, is that needle control and flow control are integral with the lower intensification ratio control. This may be satisfactory in many applications, however, as for instance, one might provide pilot injection through the control of control valve 206 only, with control valve 208 being actuated after pilot injection but before main injection, so that substantial intensification is achieved before main injection is initiated. In other embodiments, a third control valve may be provided to decouple the needle control and injection flow control from the operation of either intensifier piston, thereby providing full flexibility in operation.

In the disclosure herein, the word "actuation" and perhaps variations thereof have been used with reference to various control valves, normally electrically operated spool valves. It is to be noted that actuation is used in the general sense to indicate the change of the valve from one state to another state, whether by the application of electrical power, the removal or termination of electrical power or by some other or more complicated electrical sequence.

Figure 10A:
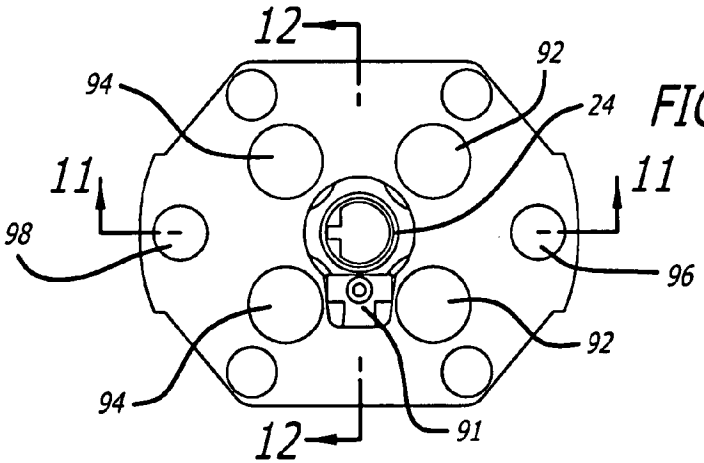
FIG. 10*a* through 10*c* show top, front, and side views of a combustion cell or air-fuel module incorporating the present invention.
Figure 10B:
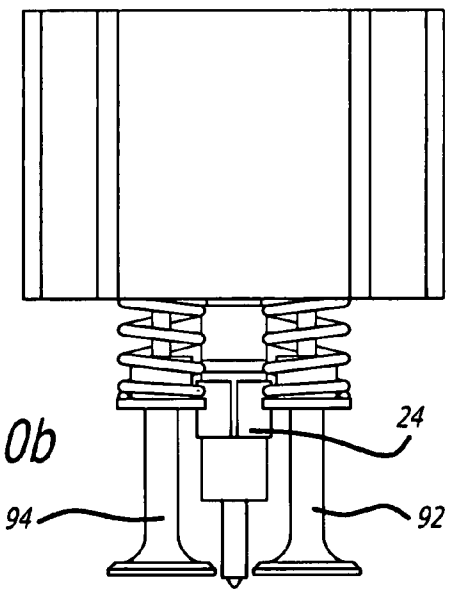
Figure 10C:
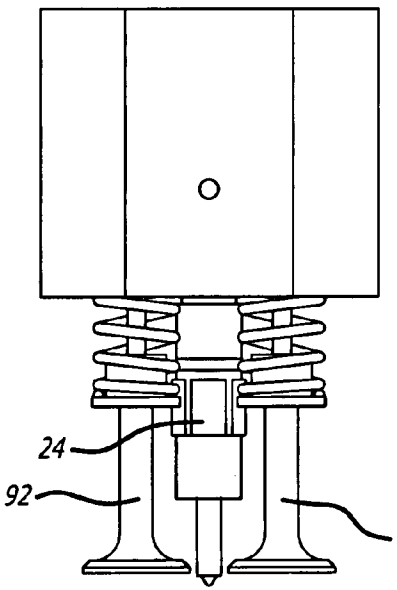

FIG. 10*a*, 10*b* and 10*c* show a top, front, and side views of a combustion cell or air-fuel module similar to the device disclosed by U.S. Pat. Nos. 6,148,778 and 6,173,685. The combustion cell may include a fuel injector 91, hydraulically actuated engine intake valves 92 and engine exhaust valves 94, and the hydraulic control valves 96 and 98 to control the actuation of the engine valves. The disclosed fuel injector may be used in such a combustion cell, as the compact arrangement of the fuel injector control valves may allow the intake and exhaust valves to be positioned in close proximity to the fuel injector.

Figure 11:
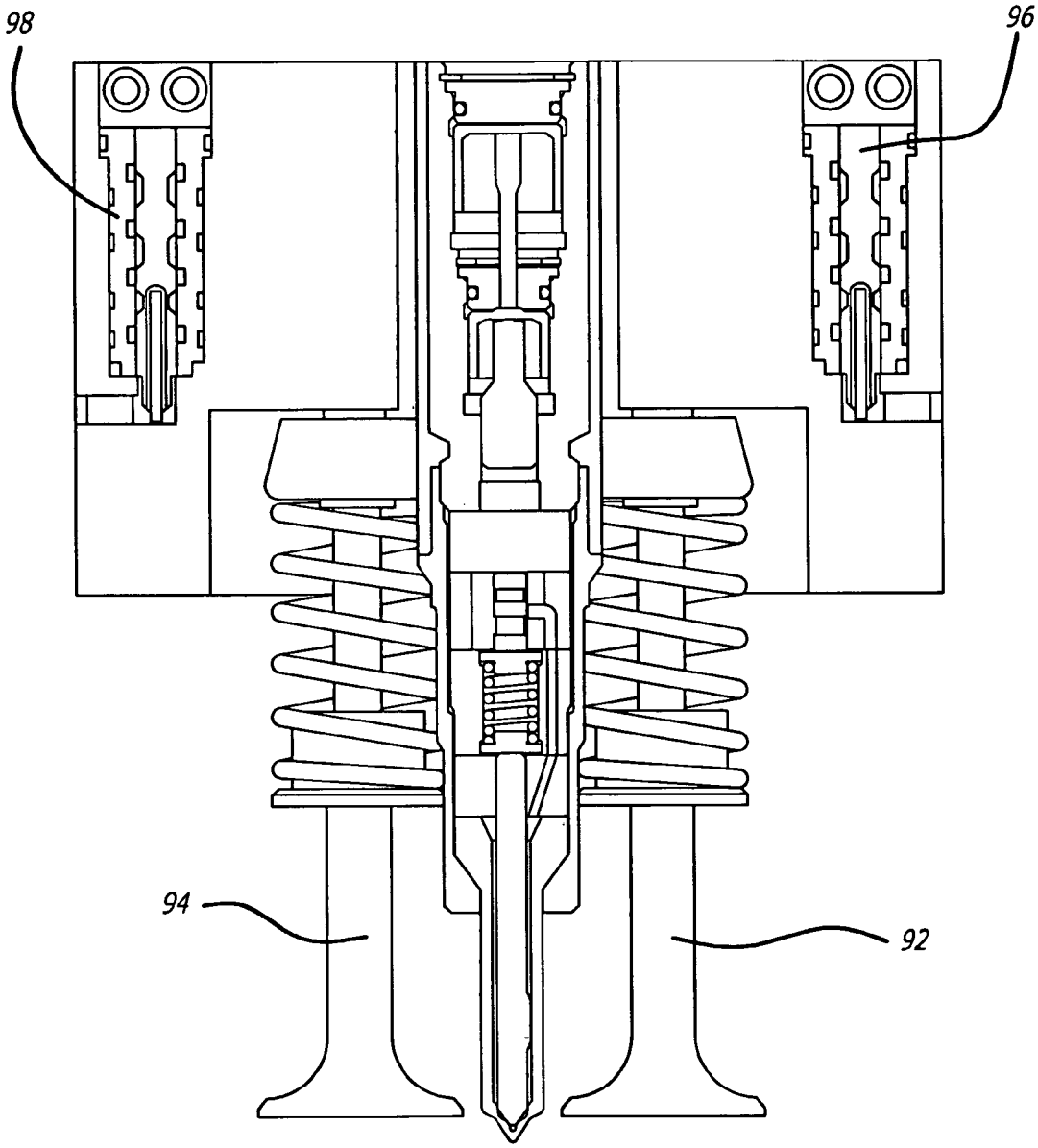
FIG. 11 shows a section view of the combustion cell through section line 1—1 of FIG. 10*a*.
Figure 12:
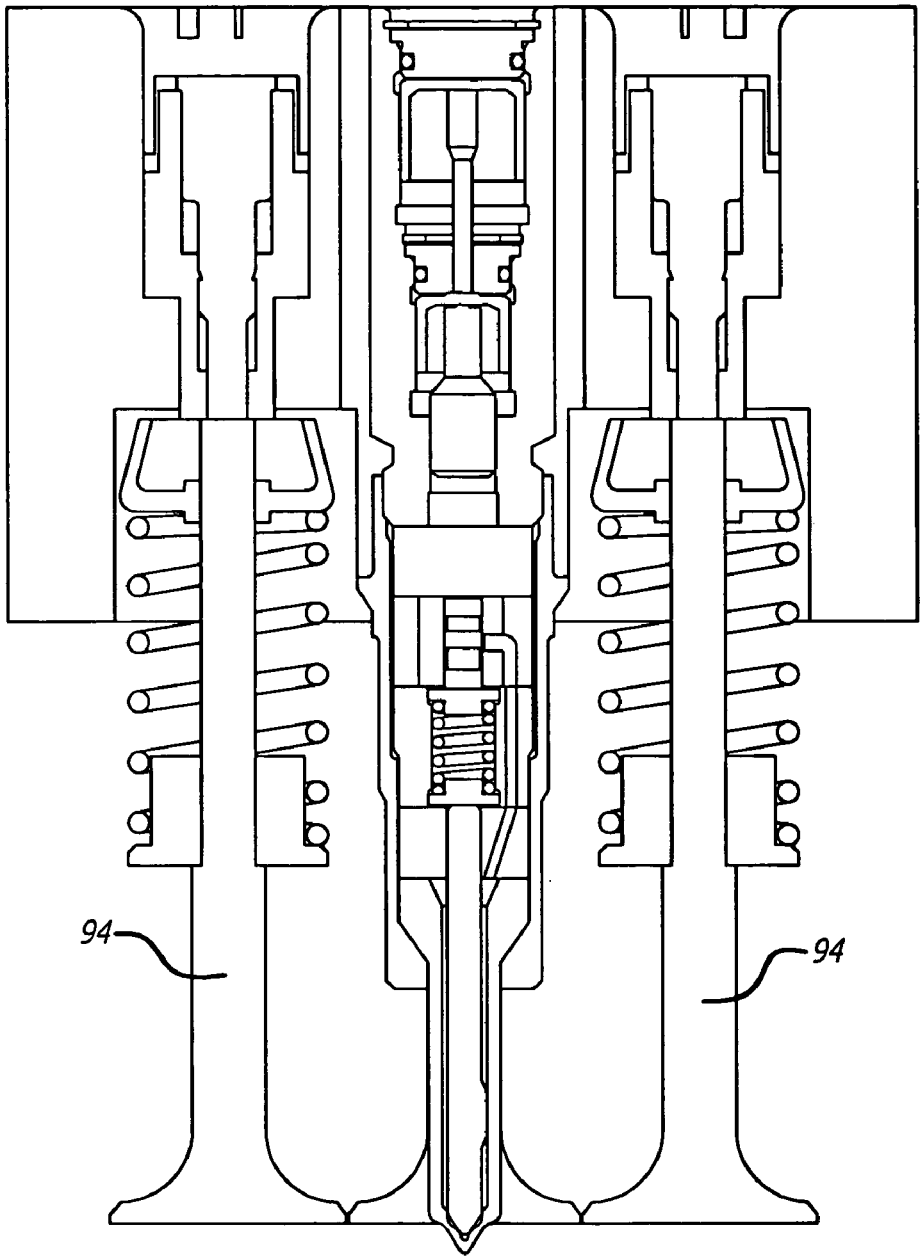
FIG. 12 shows a section view of the combustion cell through section line 2—2 of FIG. 10*a*.

FIG. 11 shows a section view of the combustion cell through section line 1—1 of FIG. 10*a*. FIG. 12 shows a section view of the combustion cell through section line 2—2 of FIG. 10*a*. The fuel injector and valves are shown relatively schematically, the Figures being presented to illustrate the suitability of the present invention to such applications.

The above description discloses certain specific embodiments the present invention. It is to be understood by those skilled in the art that further variations and enhancements may be incorporated, depending on the application, without departing from the spirit and scope of the invention, including, but not limited to, the realization of the circuit in integrated circuit (IC) form. Thus while certain preferred embodiments of the present invention have been disclosed and described herein, it will be understood by those skilled in the art that various changes in form and detail may be made therein without departing from the spirit and scope of the invention. Similarly, the various aspects of the present invention may be advantageously practiced by incorporating all features or various sub-combinations of features as desired.

What is claimed is:

1. In a fuel injector, the improvement comprising:

a nozzle to discharge fuel;

a needle disposed within the nozzle to control the discharge of fuel from the nozzle;

an intensifier having a first intensifier chamber and an actuation chamber, the intensifier also having a first actuation piston in a first actuation chamber configured to force an intensifier piston in the intensifier chamber to move with the first actuation piston when a first actuation fluid under pressure is coupled to the actuation chamber to pressurize fuel in the intensifier chamber, the first actuation piston having a larger area than an intensifier piston;

a first electrically controlled valve system coupled to the actuation chamber, to a first port adapted to couple to the first actuation fluid under pressure, and to a second port adapted to couple to a return for the first actuation fluid, the first electrically controlled valve system coupling the first port to the actuation chamber when in a first state and coupling the actuation chamber to the second port when in a second state;

a first hydraulically controlled valve in a passage between the intensifier chamber and the nozzle, the first hydraulically controlled valve coupling the intensifier chamber to the nozzle when in a first state, and coupling the nozzle to the port adapted to couple to a return for fuel when in a second state; and, a second electrically controlled valve system coupled to the first hydraulically controlled valve, to a port adapted to couple to a second actuation fluid under pressure, and to a port adapted to couple to a return for the second actuation fluid, the second electrically controlled valve system coupling the first port to the hydraulically controlled valve when in a first state to cause the hydraulically controlled valve to move to a first state, and coupling the second port to the hydraulically controlled valve when in a second state to allow the hydraulically controlled valve to move to a second state.

2. The improvement of claim 1 wherein the first hydraulically controlled valve is a spool valve.

3. The improvement of claim 1 further comprised of a spring operative between the needle and the first hydraulically controlled valve to encourage the needle to block the discharge of fuel from the nozzle and the first hydraulically controlled valve to its second state.

4. The improvement of claim 3 wherein the first hydraulically controlled valve is a spool valve and the spring acts against a spool in the spool valve.

5. The improvement of claim 3 wherein the second electrically controlled valve system comprises a first non-latching electromagnetically operated, spring return valve, the spring return encouraging the valve to its second state.

6. The improvement of claim 1 wherein the first hydraulically controlled valve couples an area over the needle to an actuation fluid return when in the first state and couples the area over the needle to an actuation fluid under pressure when in the second state.

7. The improvement of claim 6 further comprised of a spring operative between the needle and the first hydraulically controlled valve to encourage the needle to block the discharge of fuel from the nozzle and the first hydraulically controlled valve to its second state.

8. The improvement of claim 7 wherein the first hydraulically controlled valve is a spool valve and the spring acts against a spool in the spool valve.

9. The improvement of claim 1 wherein the first electrically controlled valve system comprises a second electromagnetically operated, spring return valve controlling a second hydraulically controlled valve.

10. The improvement of claim 9 wherein the second electromagnetically operated, spring return valve and the second hydraulically controlled valve are spool valves.

11. The improvement of claim 1 wherein:

the intensifier further comprises a second intensifier chamber and a second actuation piston in a second actuation chamber also configured to force the intensifier piston in the intensifier chamber to move with the second actuation piston when fluid at an actuation pressure is coupled to the second actuation chamber to pressurize fuel in the intensifier chamber, the second actuation piston also having a larger area than the intensifier piston;

and further comprising:

a third electrically controlled valve system coupled to the second actuation chamber, to the first port and to the second port, the third electrically controlled valve system coupling the first port to the second actuation chamber when in a first state and coupling the second actuation chamber to the second port when in a second state.

12. The improvement of claim 11 wherein the second actuation piston has a different area than the first actuation piston.

13. The improvement of claim 12 wherein the second actuation piston in the second actuation chamber is coaxial with the first actuation piston in the first actuation chamber, and is configured to force the intensifier piston in the intensifier chamber to move with the second actuation piston when fluid at an actuation pressure is coupled to the second actuation chamber by the coupling of the force to the first actuation piston.

14. The improvement of claim 12 wherein the third electrically controlled valve system comprises a third electromagnetically operated, spring return valve controlling a third hydraulically controlled valve.

15. The improvement of claim 14 wherein the third electromagnetically operated, spring return valve and the third hydraulically controlled valve are spool valves.

16. The improvement of claim 1 wherein the first and second ports are adapted to be coupled to fuel under pressure and to a fuel return, and the second electrically controlled valve is coupled to the first and second ports.

17. The improvement of claim 16 wherein the first hydraulically controlled valve also couples an area over the needle to the second port when in the first state and couples the area over the needle to the first port when in the second state.

18. The improvement of claim 17 further comprised of a spring operative between the needle and the first hydraulically controlled valve to encourage the needle to block the discharge of fuel from the nozzle and the first hydraulically controlled valve to its second state.

19. The improvement of claim 18 wherein the first hydraulically controlled valve is a spool valve and the spring acts against a spool in the spool valve.

20. The improvement of claim 1 wherein the first and second ports are adapted to be coupled to fuel under pressure and to a fuel return, and the hydraulically controlled valve actuation fluid under pressure is engine oil.

21. In a fuel injector, the improvement comprising:

a nozzle to discharge fuel;

a needle disposed within the nozzle to control the discharge of fuel from the nozzle;

an intensifier having a first intensifier chamber and an actuation chamber, the intensifier also having a first actuation piston in a first actuation chamber configured to force an intensifier piston in the intensifier chamber to move with the first actuation piston when an actuation fluid under pressure is coupled to the actuation chamber to pressurize fuel in the intensifier chamber, the first actuation piston having a larger area than an intensifier piston;

a first hydraulically controlled valve in a passage between the intensifier chamber and the nozzle, the first hydraulically controlled valve coupling the intensifier chamber to the nozzle when in a first state, and coupling the nozzle to the port adapted to couple to a return for fuel when in a second state;

a first electrically controlled valve system coupled to the actuation chamber, to a first port adapted to couple to an actuation fluid under pressure, and to a second port adapted to couple to a return for actuation fluid, the first electrically controlled valve system coupling the first port to the actuation chamber when in a first state and coupling the actuation chamber to the second port when in a second state; and, a second electrically controlled valve system coupled to the first hydraulically controlled valve, the second electrically controlled valve system coupling the hydraulically controlled valve to a port adapted to be coupled to a hydraulically controlled valve actuation fluid under pressure when in a first state to cause the hydraulically controlled valve to move to a first state, and coupling the hydraulically controlled valve to a port adapted to be coupled to a hydraulically controlled valve actuation fluid return when in a second state to cause the hydraulically controlled valve to move to a second state.

22. The improvement of claim 21 wherein the first hydraulically controlled valve is a spool valve.

23. The improvement of claim 21 further comprised of a spring operative between the needle and the first hydraulically controlled valve to encourage the needle to block the discharge of fuel from the nozzle and the first hydraulically controlled valve to its second state.

24. The improvement of claim 23 wherein the first hydraulically controlled valve is a spool valve and the spring acts against a spool in the spool valve.

25. The improvement of claim 23 wherein the second electrically controlled valve system comprises a first non-latching electromagnetically operated, spring return valve, the spring return encouraging the valve to its second state.

26. The improvement of claim 21 wherein the first hydraulically controlled valve couples an area over the needle to an actuation fluid return when in the first state and couples the area over the needle to an actuation fluid under pressure when in the second state.

27. The improvement of claim 26 further comprised of a spring operative between the needle and the first hydraulically controlled valve to encourage the needle to block the discharge of fuel from the nozzle and the first hydraulically controlled valve to its second state.

28. The improvement of claim 27 wherein the first hydraulically controlled valve is a spool valve and the spring acts against a spool in the spool valve.

29. The improvement of claim 21 wherein the first electrically controlled valve system comprises a second electromagnetically operated, spring return valve controlling a second hydraulically controlled valve.

30. The improvement of claim 29 wherein the second electromagnetically operated, spring return valve and the second hydraulically controlled valve are spool valves.

31. The improvement of claim 21 wherein:

the intensifier further comprises a second intensifier chamber and a second actuation piston in a second actuation chamber also configured to force the intensifier piston in the intensifier chamber to move with the second actuation piston when fluid at an actuation pressure is coupled to the second actuation chamber to pressurize fuel in the intensifier chamber, the second actuation piston also having a larger area than the intensifier piston;

and further comprising:

a third electrically controlled valve system coupled to the second actuation chamber, to the first port and to the second port, the third electrically controlled valve system coupling the first port to the second actuation chamber when in a first state and coupling the second actuation chamber to the second port when in a second state.

32. The improvement of claim 31 wherein the second actuation piston has a different area than the first actuation piston.

33. The improvement of claim 32 wherein the second actuation piston in the second actuation chamber is coaxial with the first actuation piston in the first actuation chamber, and is configured to force the intensifier piston in the intensifier chamber to move with the second actuation piston when fluid at an actuation pressure is coupled to the second actuation chamber by the coupling of the force to the first actuation piston.

34. The improvement of claim 33 wherein the third electromagnetically operated, spring return valve and the third hydraulically controlled valve are spool valves.

35. The improvement of claim 32 wherein the third electrically controlled valve system comprises a third electromagnetically operated, spring return valve controlling a third hydraulically controlled valve.

36. The improvement of claim 21 wherein the first and second ports are adapted to be coupled to fuel under pressure and to a fuel return, and the second electrically controlled valve is coupled to the first and second ports.

37. The improvement of claim 36 wherein the first hydraulically controlled valve also couples an area over the needle to the second port when in the first state and couples the area over the needle to the first port when in the second state.

38. The improvement of claim 37 further comprised of a spring operative between the needle and the first hydraulically controlled valve to encourage the needle to block the discharge of fuel from the nozzle and the first hydraulically controlled valve to its second state.

39. The improvement of claim 38 wherein the first hydraulically controlled valve is a spool valve and the spring acts against a spool in the spool valve.

40. The improvement of claim 21 wherein the actuation fluid under pressure and the hydraulically controlled valve actuation fluid under pressure are both fuel.

41. The improvement of claim 21 wherein the actuation fluid under pressure is engine oil and the hydraulically controlled valve actuation fluid under pressure is fuel.

* * * * *